United States Patent [19]

Guerin

[11] Patent Number: 4,643,384

[45] Date of Patent: Feb. 17, 1987

[54] EASEL

[76] Inventor: Charles A. Guerin, 1023 N. Weber St., Colorado Springs, Colo. 80903

[21] Appl. No.: 815,938

[22] Filed: Jan. 3, 1986

[51] Int. Cl.[4] ..... A47B 97/08

[52] U.S. Cl. ..... 248/476; 248/449; 248/452; 248/453; 248/229

[58] Field of Search ..... 248/448, 449, 451–453, 248/478, 231.1, 201.1, 336, 476, 477, 478, 447.1, 225.31, 229, 447.2; 256/37

[56] References Cited

U.S. PATENT DOCUMENTS

| | | | |
|---|---|---|---|
| 394,856 | 12/1888 | Hendrick | 248/448 |
| 1,287,699 | 12/1918 | Kinsman | 248/476 |
| 3,799,488 | 3/1974 | Sena | 248/452 |

FOREIGN PATENT DOCUMENTS

| | | | |
|---|---|---|---|
| 1044487 | 9/1966 | United Kingdom | 248/449 |

OTHER PUBLICATIONS

Charvoz-Carsen Corporation, Fairfield, N.J., catalog entitled Charvoz Fine Arts Easels.

Art Hardware, Boulder, Colorado, 1983 catalog of art supplies, pp. 157–159.

DE-STA-CO Division of Dover Corp., Troy, Michigan, catalog No. 484, p. 27.

*Primary Examiner*—Reinaldo P. Machado
*Assistant Examiner*—A. Chin-Shue
*Attorney, Agent, or Firm*—Hill, Van Santen, Steadman & Simpson

[57] ABSTRACT

A studio easel for selective tension or compression clamping of a canvas painting stretcher frame having top and bottom cross bars in fixed upright position at a desired level has a pair of elongated channel tracks for mounting upright in laterally spaced relation on a studio wall with a pair of opposed shoes slidable in each track. Grip locks on the shoes secure them to their tracks, a stretcher frame support on one shoe of each pair engages a cross bar of the frame. A push-pull clamp on the other shoe of the pair engages the opposite cross bar of the stretcher frame. The shoes are mounted for stretch clamping the frame by positioning the frame support shoe above the push-pull clamp shoes, hanging the top cross bar of the frame on the support shoes, engaging the bottom support frame with the push-pull clamps and pulling the clamps to stretch the frame. In the compression loading position the support shoes are mounted under the push-pull clamp shoes with the bottom cross bar of the frame resting on the supports and with the clamps being pushed against the top cross bar to force the frame downwardly against the bottom supports. For small frames, a single track arrangement can be provided.

15 Claims, 11 Drawing Figures

EASEL

BACKGROUND OF THE INVENTION

This invention relates to the art of easels especially for fixedly clamping stretcher canvas frames in fixed upright position and specifically deals with wall mounted easels having elongated upright channel tracks with shoes slidable on these tracks and locked at selective heights to tension mount or compression mount the frame in fixed upright position at a desired level without covering any portion of the canvas.

DESCRIPTION OF RELATED ART

Conventional easels have required considerable floor space taking up valuable room in a studio or the like. These easels are either heavy and cumbersome to provide solid support for the canvas stretcher frame or, if made light in weight, will shift under operating conditions, frequently falling over and causing damage to the painting. Such easels also cover, or make inaccessible for painting, margin portions of the canvas.

It would therefore be an improvement in this art to provide easels requiring little or no floor space and yet capable of easily clamping a canvas frame in fixed position at a desired height without covering any portions of the canvas. It would be a further improvement in this art to provide a studio wall mounted easel which selectively tension or compression clamps a canvas stretcher frame in fixed position at a desired convenient level for the artist.

SUMMARY OF THIS INVENTION

According to this invention, a studio easel is provided with a pair of elongated channel tracks which are easily affixed in upright spaced parallel relation to a studio wall. These tracks slidably mount shoes or carriages to anchor the stretcher frame in fixed upright position on the studio wall. Each track supports a pair of shoes. One shoe of each pair has a pad from which the stretcher frame can be hung or can rest thereon. The other shoe of each pair has a push-pull clamp which pulls the stretcher frame away from the support pad shoe or pushes it toward this shoe to selectively provide a tension clamp or a compression clamp locking of the frame to the tracks.

The shoes have friction grip locks which can be tightened on the tracks to secure them at fixed levels.

The push-pull clamp has an adjustable finger engaging the upper face of the bottom cross bar of the stretcher frame in the tension clamping arrangement or engaging the top face of the top cross bar of the stretcher frame in the compression clamping arrangement.

The push-pull clamps have overcenter toggle actuated plungers to lock the fingers in their extended push positions or in their retracted pull positions.

The preferred tracks are U-shaped channels with a bottom web or bight portion fixedly secured in upright position to the studio wall as by means of screws threaded into the wall studs or anchor bolts secured in masonry walls. The side legs of the channel project inwardly from the wall and have inturned lips extending into the channel. This provides outer rim track surfaces on which the shoes ride. The shoes also have ribs extending into the open mouths of the channels. Bolts extending through the shoes have plate nuts riding on the inner edges of the inturned lips of the tracks.

Tightening of one of the nuts against the lips fixedly clamps the shoe in position.

The support shoes and the clamp shoes are easily reversed on the tracks to convert the tension clamp arrangement to a compression clamp arrangement as described.

No portion of the shoes or the mountings thereon overlie the canvas of the frame and all support for the frame is behind the canvas.

The easel accommodates any size canvas frame from say about 1 foot to 100 feet in length and from 6 inches to 20 feet in height. This is achieved by selective spacing of the tracks on the studio wall and by the lengths of the tracks. Since few artists produce paintings 20 feet tall, the track sizes are preferably manufactured in 8 to 10 lengths and are mounted from 16 to 32 inches apart to accommodate the normal needs of the professional painter producing paintings in the 24 by 24 inch to an 8 by 10 foot range.

If very small canvas frames are to be mounted, one of the two tracks can be eliminated and the support shoe provided with a T-shaped mounting pad having a head that will span a considerable length of a cross bar of the frame.

It is then an object of this invention to provide an easel requiring little or no floor space and adjustable to tension or compression clamp stretched canvas frames for painting in fixed upright position at a selective level.

Another object of the invention is to provide a wall mounted studio easel securely holding a stretched canvas frame during the process of painting in an upright position at a selected level.

Another object of the invention is to povide an easel with clamps providing positive clamping pressure allowing a compression or tension loaded condition.

A further object of the invention is to provide an easel for canvas stretcher frames which supports one cross bar of the frame on two adjustable height support members and then pushes or pulls the opposite cross bar of the frame into tension or compression loaded relation with the two support members.

Another object of this invention is to provide a wall mounted easel which will tension or compression clamp a canvas stretcher frame without obstructing any portion of the canvas.

Other and further objects of the invention will be apparent to those skilled in this art from the following detailed description of the annexed sheets of drawings which, by way of best mode embodiments illustrate two modifications of the invention.

BRIEF DESCRIPTION OF THE ILLUSTRATED PREFERRED EMBODIMENTS

Figure 2:
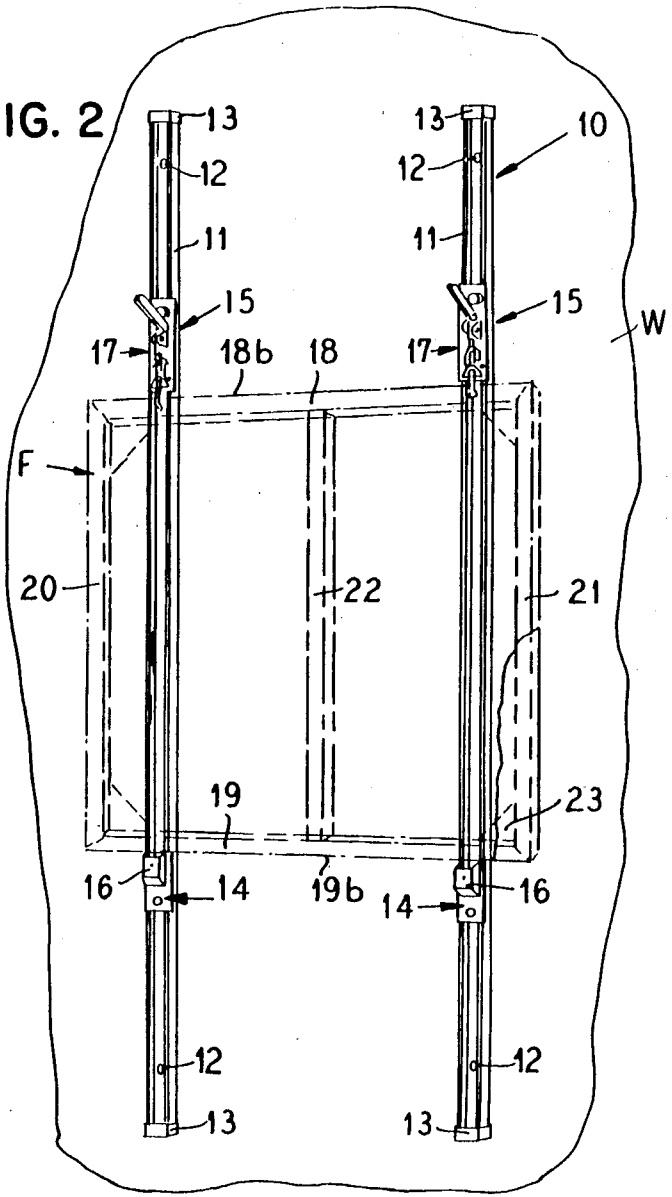
FIG. 2 is a view similar to FIG. 1, but showing compression clamping of the canvas stretcher frame on the easel.
Figure 1:
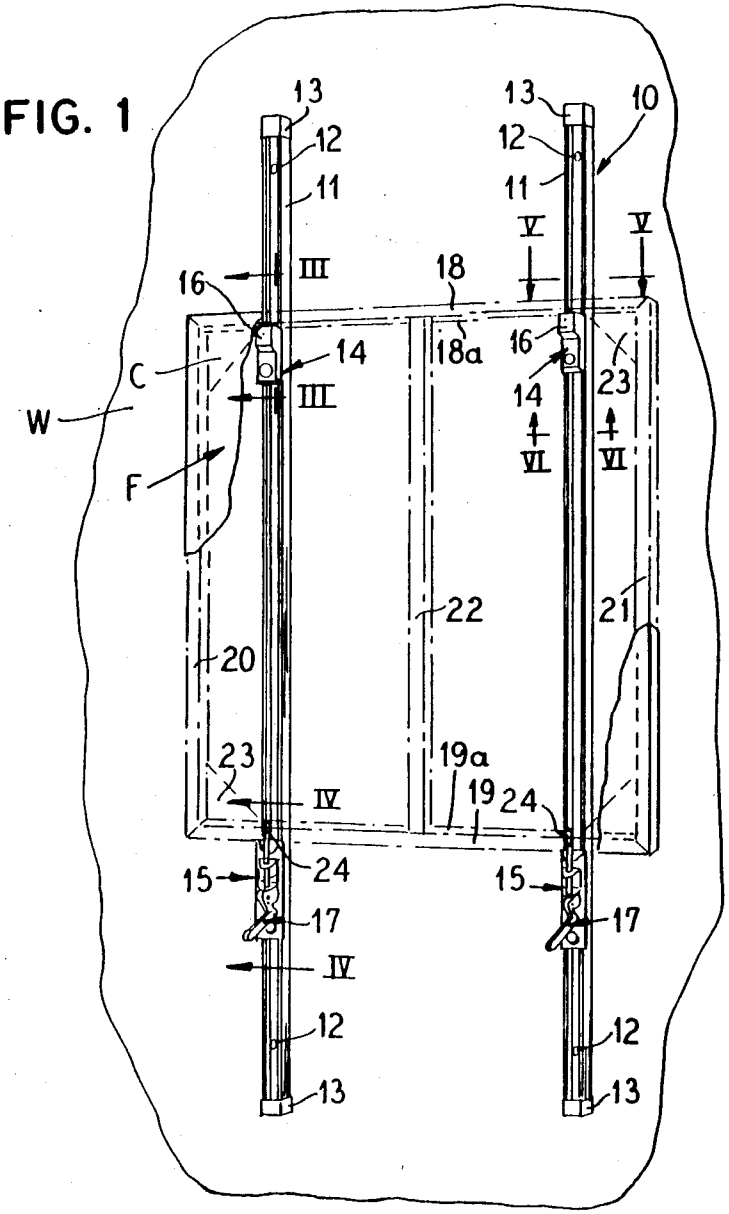
FIG. 1 is a front elevational view of a wall mounted easel according to this invention showing tension clamping of a canvas stretcher frame on the easel.

The easel 10 illustrated in FIGS. 1 and 2 has a pair of upstanding elongated channel tracks 11 mounted in spaced parallel relation on a wall W of a studio or the like by means of fastener screws or bolts 12, preferably about 6" from the top and bottom ends of the tracks, screwed in the wall studs. The ends of the tracks 11 are spaced below the ceiling and above the floor of the studio and are covered by removable rubber or plastic end caps 13.

Each track 11 sidably mounts a pair of shoes 14 and 15. In the illustrated position of FIG. 1, the shoes 14 are above the shoes 15 and carry support pads or blocks 16. The bottom shoes 15 carry push-pull clamps 17.

A stretched canvas frame F illustrated in dotted lines is mounted on the easel and in the illustrated position of FIG. 1 a top cross bar 18 of this frame F has an inner face 18*a* resting on the support blocks 16. The frame F also has a bottom cross bar 19 with an inner face 19*a*. The bars 18 and 19 are connected by vertical bars 20 and 21 providing a rectangular frame. A reinforcing strut bar 22 is also provided midway between the bars 21. Corner brackets 23 reinforce the connections between the horizontal cross bars 18 and 19 and the vertical bars 20 and 21.

A canvas C is stretched over the front face of the frame and affixed to the bars by staples or the like. The bars of the frame project rearwardly from this canvas and in the illustrated position of FIG. 1 the inner face 18*a* of the top cross bar 18 is suspended on the supporting blocks 16 so that the frame will hang downwardly in front of the tracks. Also in the FIG. 1 position, the bottom shoes 15 are positioned below the bottom cross bar 19 and fingers 24 actuated by the push-pull clamps 17 overlie the inner face 19*a* of the bottom cross bar. The clamps are then pulled to retract these fingers 24 thereby stretching or tensioning the frame F and providing a fixed clamped engagement of the frame with the tracks.

In the FIG. 2 position of the easel 10, the shoes 14 and 15 are slipped off the ends of the tracks and are reversed with the shoes 14 being positioned under the frame F and the support blocks or pads 16 engaging the outer face 19*b* of the bottom cross bar 19. The frame F therefore rests on these blocks 16 and projects upwardly therefrom on the tracks 11.

The push-pull clamp carrying shoes 15, which are now above the shoes 14, are positioned above the top cross bar 18 of the frame F and the hook fingers 24, used in the FIG. 1 position, are replaced with fingers 25 (FIG. 8) which have heads engaging the outer or top face 18*b* of the top cross bar 18. The clamps 17 are actuated to propel these fingers 25 downwardly with their heads pressed against the top cross bar 18 thereby placing a compression load on the frame F and causing it to be compression clamped between the bottom support blocks 16 and the top fingers of the clamps 17.

Figure 9:
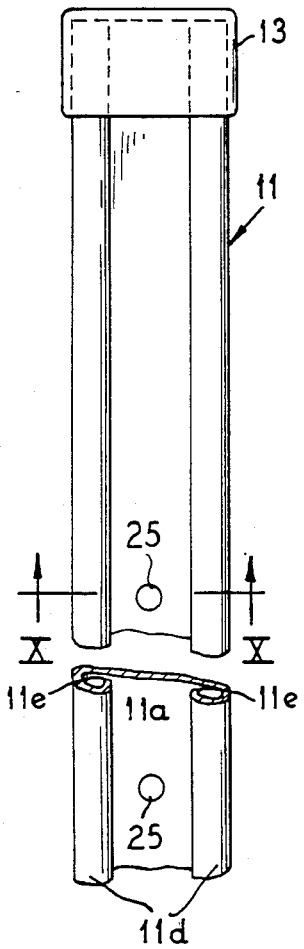
FIG. 9 is a broken fragmentary front elevational view of one of the tracks.
Figure 10:
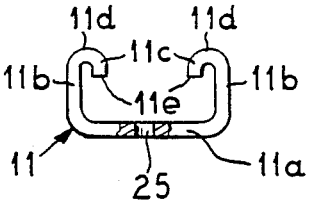
FIG. 10 is a transverse cross-sectional view along the line X—X of FIG. 9.

As best illustrated in FIGS. 9 and 10, each track 11 is a metal channel beam with a generally U-shaped cross section having a flat web or bight 11*a*, parallel side legs 11*b* projecting from the web and inturned lips 11*c* on the inner ends of these legs providing spaced parallel outer support faces 11*d* and inner support edges 11*e*. A row of holes 25 is provided through the web 11*a* for receiving the screw fasteners 12 (FIGS. 1 and 2) to secure the tracks in position on a wall W.

Figure 3:
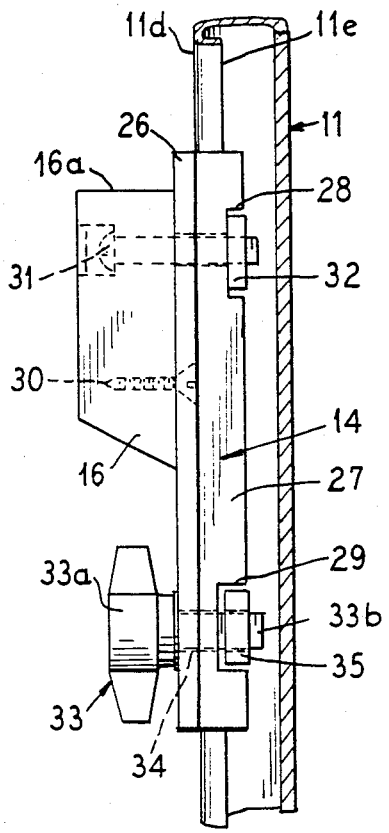
FIG. 3 is an enlarged longitudinal cross-sectional view along the line III—III of FIG. 1.
Figure 5:
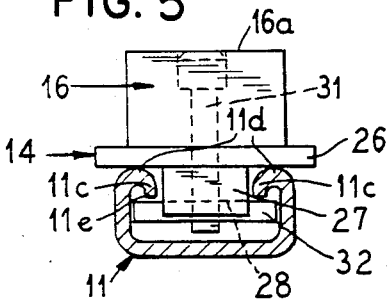
FIG. 5 is an enlarged transverse cross-sectional view along the line V—V of FIG. 1.

As illustrated in FIGS. 3 and 5, the shoe 14 has a flat base plate 26 riding on the support faces 11*d* of the track. This plate has a central depending rib 27 projecting into the channel of the track 11 with the side edges thereof riding on the inturned lips 11*c*. The bottom face of the rib 27 has a pair of transverse slots 28 and 29 thereacross.

A screw 30 secures the block 16 to the plate 26 and a bolt 31 extending through the block and shoe 14 into the slot 28 has a slide plate nut 32 threaded thereon in the slot riding freely on the inner edges 11*e* of the track lips 11*c*. The support block 16 of the shoe 14 may be formed of rubber, wood, plastic or the like and projects from the shoe to provide a flat top surface 16*a* fitting under or over the top or bottom cross bar of the frame F to form a good support for the frame.

Figure 6:
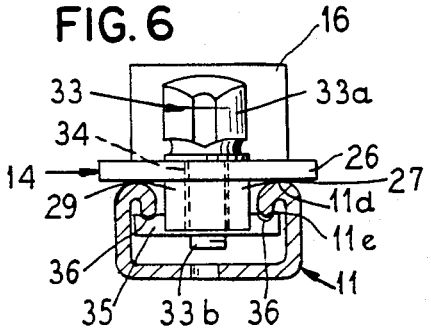
FIG. 6 is an enlarged transverse cross-sectional view along the line VI—VI of FIG. 1.

As shown in FIGS. 3 and 6, the shoe 14 also rotatably carries a clamping bolt 33 near the end thereof opposite the bolt 31. This bolt 33 has a wing head 33*a* bottomed on the plate 26 with a threaded shank 33*b* extending freely through a hole 34 in the plate 26 and rib 27 into the slot 29. A clamping plate nut 35 in the slot is threaded on the shank 33*b* and extends under the track lip edges 11*e*. The face of the nut 35 overlying the edges 11*e* has grooves 36 receiving these edges. When the bolt 33 is loosened the nut 35 slides freely along the edges 11*e* but when the bolt is tightened the grooves 36 of the nut are drawn into locked gripping engagement with the edges thereby fixedly securing the shoe 14 to the track 11. The slide nut 32 is not tightened by the bolt 31 but it guides the shoe on the track to cooperate with the nut 35 to prevent cocking of the shoe.

Figure 4:
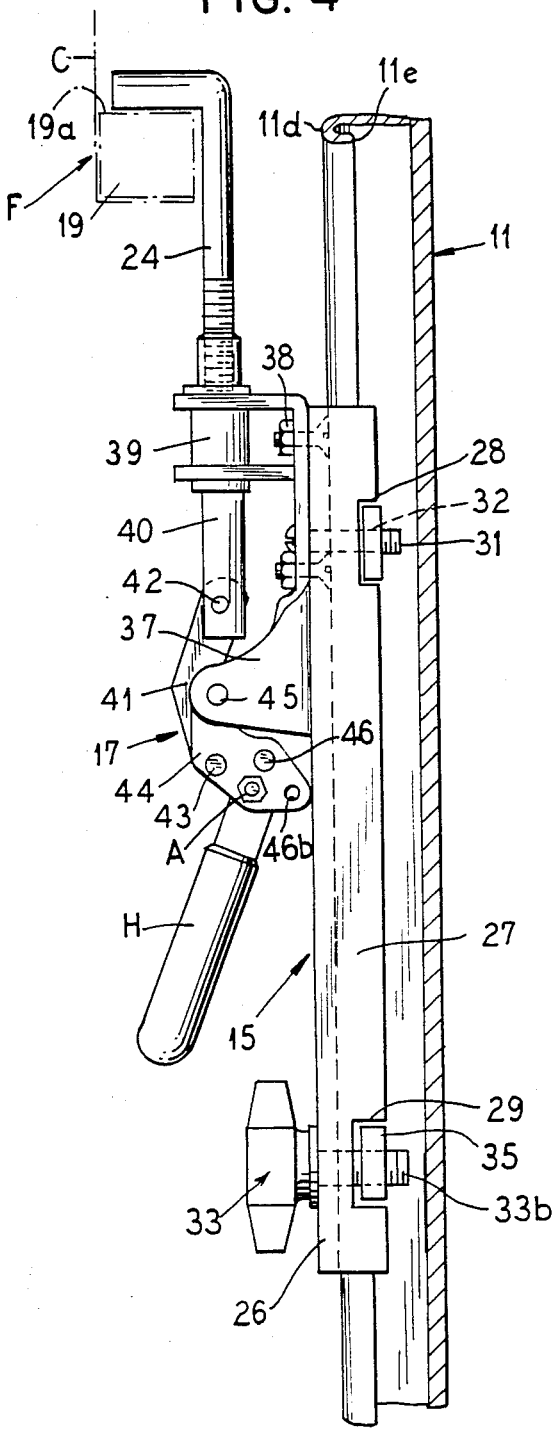
FIG. 4 is an enlarged longitudinal cross-sectional view along the line IV—IV of FIG. 1.
Figure 7:
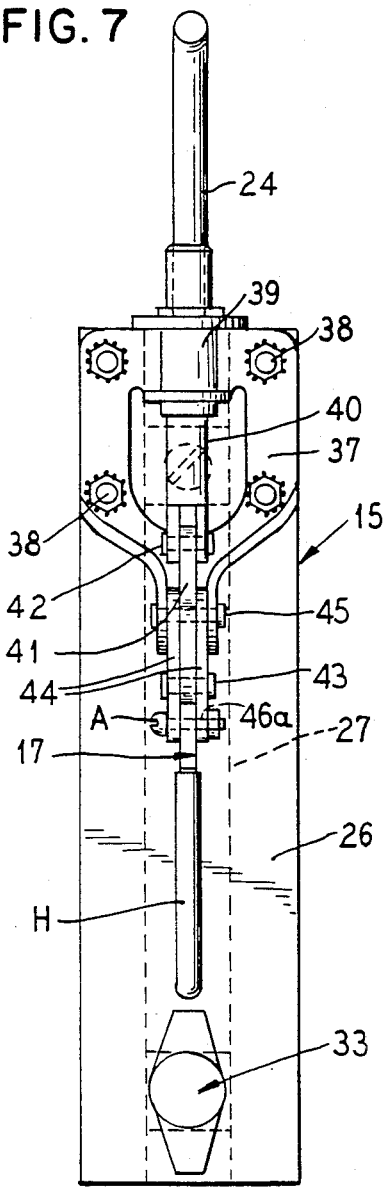
FIG. 7 is a top plan view of the push-pull clamp with an L-shaped finger for tension clamping.

As shown in FIGS. 4 and 7, the shoe 15 has the same base plate 26, rib 27, bolt 31, slide nut 32, clamping bolt 33 and nut 35 as the shoe 14 and corresponding parts have been marked with the same reference numerals. The shoe 15 thereby rides on and is locked in fixed position on the track 11 in the same manner as the shoe 14.

The push-pull clamp 17 has a frame 37 secured on top of the plate 26 by means of fasteners 38. This frame supports a bearing 39 slidably receiving a plunger rod 40 therethrough. The rear end of this plunger rod 40 is pinned to a link 41 at 42 which link 41 in turn is pinned at 43 between rocker arm plates 44 which are pivoted at 45 to the frame 37. A handle H projects between the plates 44 and is swingable on a pin 46 extending between and secured to the plates 44. This handle H is selectively fixed to the plates 44 in one of two positions. For this purpose the plates have holes 46*a* and 46*b* alongside the pin 46 to selectively receive a nut and bolt assembly A extending therethrough and through a corresponding hole in the handle H.

An overcenter toggle actuator is thereby provided with a first position for the handle H having the nut and bolt assembly A seated in the holes 46*a* of the rocker arm plates 44 as illustrated in FIGS. 4 and 7 to pull and lock the plunger 40 in a retracted position for tensioning the frame F. To push the plunger 40 in an extended position for compression locking the frame F, the nut and bolt assembly A is removed from the holes 46*a*, the handle is swung about the pin 46 into alignment with the holes 46*b* and the nut and bolt assembly 40*a* is inserted through these holes 46*b*. Then the handle is free to clear the link 41 to be pushed over the plunger 40 causing it to extend to its maximum position.

Figure 8:
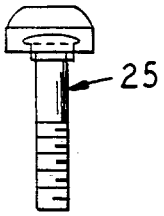
FIG. 8 is a side elevational view of a compression finger for the push-pull clamp.

The projecting leading end of the plunger 40 beyond the frame is internally threaded to selectively receive the finger 24 as shown in FIGS. 4 and 7 or the headed finger pin 25 of FIG. 8. The threaded relationship of the finger members 24 and 25 with the plunger 40 provides a micrometer adjustment to control the amount of tension or compression applied to the frame F by the push-pull clamps.

From the above descriptions it will therefore be understood that the canvas stretcher frame F is either suspended on the support blocks 16 and tension stressed by the push-pull clamps 17 on the shoes 15 as in the FIG. 1 position or rests on the blocks 16 and is compression clamped by the push-pull clamps 17 in the FIG. 2 position.

Figure 11:
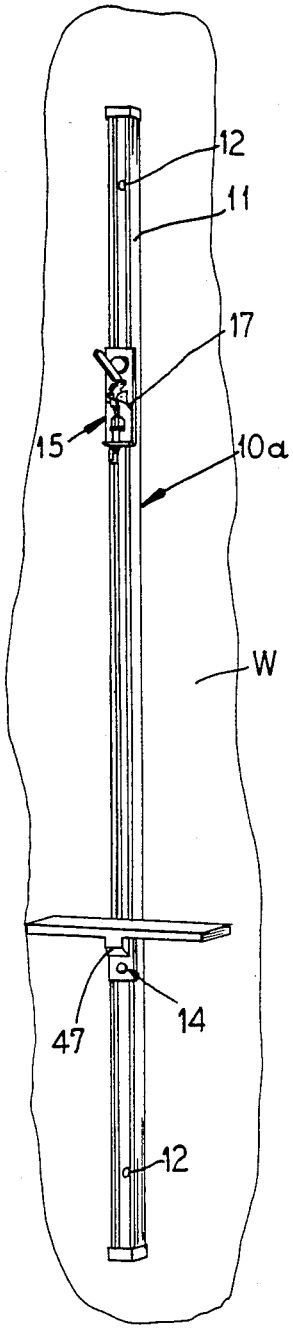
FIG. 11 is a view similar to FIG. 2, but showing a single track easel of this invention for small paintings.

In the modified easel 10*a* of FIG. 11, parts corresponding with the easel 10 described hereinabove, have been marked with the same reference numerals. As shown in FIG. 11, however, only a single track 11 is mounted on the wall W and the shoes 14 and 15 are mounted on this single track. Alternately, of course, one of the two tracks 11 of the easel 10 installation can be used. However, the support block 16 of the shoe 14 is replaced with a T-shaped block 47 which provides extended engagement with a top or bottom cross bar of the frame. In the illustrated position the bottom cross bar 18 of the frame would rest on the elongated head of the block 47, but, of course, the position of the shoe 14 could be reversed so that the support block would underlie the top cross bar of the frame.

Although the invention has been described with respect to preferred embodiments, it is not to be so limited as changes and modifications can be made which are within the full intended scope of the invention as defined by the appended claims.

I claim as my invention:

1. An easel for clamping in upright position at a desired level a canvas stretching frame with top and bottom cross bars having inner and outer faces behind the canvas which comprises an elongated track means, means for mounting said track means in upright position, a plurality of shoe means reversibly mounted on said track means in first and second positions, means locking said shoe means at selected levels on said track means, means on said shoe means respectively engaging an inner face of a frame cross bar in a first position of the shoe means and an outer face of a cross bar in a second position of the shoe means, and a push-pull clamp on a shoe means shiftable to selectively tension clamp and compression clamp the frame to the track means.

2. The easel of claim 1 wherein the track means includes a pair of channel tracks in laterally spaced relation and a pair of shoe means slidable on each track.

3. The easel of claim 1 wherein the means for mounting the track means in upright position are fasteners anchored to a studio wall.

4. The easel of claim 1 wherein the track means is a single track.

5. The easel of claim 1 wherein the track means includes a channel track with an open slot along the length thereof and the shoe means ride on the channel track and project through the slot.

6. The easel of claim 5 wherein the portion of the shoe means projecting into the slot have members depending therefrom engaging the track means on opposite sides of the slot.

7. The easel of claim 1 wherein the track means includes a U-shaped elongated member having a bight portion adapted to be secured to a studio wall, side legs projecting from the bight portion, inturned lips on the side legs and a slot between the lips, and wherein each shoe means has a base plate riding on the side legs with a rib projecting through the slot, and means depending from the shoe means overlie the lips to retain the shoe means on the track.

8. The easel of claim 7 including bolts extending through the shoe means into the channel of the track, and nuts threaded on said bolts riding on the lips of the track to support the shoes on the track in slidable relation.

9. The easel of claim 8 wherein one of said bolts is rotatable to tighten the screw means against the track lips into fixed gripping relation therewith for locking the shoe means in position on the track.

10. The easel of claim 1 including channel tracks, shoe means slidably supported on said tracks with rib portions projecting into the channel, transverse slots in the rib means, plate nuts in said slots riding on the track means, and bolts rotatably supported on the shoe means threaded into said plate nuts.

11. The easel of claim 10 wherein one of the bolts is a clamp bolt and the plate nut thereon has grooves receiving the channel track.

12. The easel of claim 1 wherein the clamp selectively mounts compression and tension fingers for engaging a cross bar of the frame.

13. The easel of claim 12 wherein the fingers are adjustable on the clamp to control the clamp load on the frame.

14. A studio easel for tension clamping of a canvas stretching frame with a top cross bar having an under face and a bottom cross bar having a top face in fixed upright position at a desired level which comprises a pair of elongated channel tracks, means for mounting said tracks in upright laterally spaced position on a studio wall, top and bottom shoes slidably mounted on each track, means locking said shoes at selected levels on the tracks, means on the top shoes engaging the under face of the top cross bar to suspend the frame on the tracks, and push-pull clamp means on the bottom shoes engaging the top face of the bottom cross bar for tension loading the frame on the tracks.

15. A studio easel for compression clamping of a canvas stretching frame with a top cross bar having a top face and a bottom cross bar having a bottom face in fixed upright position at a desired level which comprises a pair of elongated channel tracks, means for mounting said tracks in upright laterally spaced relation on a studio wall, top and bottom shoes slidably mounted on each track, means locking said shoes at selective levels on the tracks, means on the bottom shoes engaging the bottom face of the bottom cross bar to support the frame on the tracks, and push-pull clamp means on the top shoes engaging a top face of the top cross bar for compression loading the frame on the tracks.

* * * * *